US006227088B1

(12) United States Patent
Cestonaro et al.

(10) Patent No.: US 6,227,088 B1
(45) Date of Patent: May 8, 2001

(54) APPARATUS FOR OPENING PAPER BOBBINS

(75) Inventors: Jean Cestonaro, Marin; David Vuilleumier, Colombier; Pascal Christen, Cortaillod, all of (CH)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 08/570,278

(22) Filed: Dec. 11, 1995

(30) Foreign Application Priority Data

Dec. 12, 1994 (EP) ..... 94810716

(51) Int. Cl.[7] ..... B26D 7/14

(52) U.S. Cl. ..... 83/176; 83/368; 83/454; 83/456; 83/465; 83/557; 83/562; 83/563; 83/949; 83/614; 242/523.1; 242/527; 242/562

(58) Field of Search ..... 242/562, 523.1, 242/527, 527.7; 83/176, 368, 371, 454, 456, 457, 465, 557, 562, 563, 924, 949, 614

(56) References Cited

U.S. PATENT DOCUMENTS

| | | | | |
|---|---|---|---|---|
| 1,914,528 | * | 6/1933 | Reid | 83/176 |
| 2,747,666 | * | 5/1956 | Brooks | 83/368 |
| 3,121,300 | * | 2/1964 | Rossi . | |
| 4,158,417 | * | 6/1979 | Inoue | 83/924 |
| 4,344,268 | * | 8/1982 | Wakamatsu et al. | 83/176 |
| 4,399,729 | * | 8/1983 | Malinowski et al. | 83/455 |
| 4,437,223 | * | 3/1984 | Petros | 83/924 |
| 4,516,451 | * | 5/1985 | Takeshita et al. | 83/455 X |
| 4,579,293 | * | 4/1986 | Steiniger . | |
| 4,821,971 | * | 4/1989 | Watanabe et al. | 83/614 |
| 4,995,406 | | 2/1991 | da Silva | 131/105 |
| 5,018,535 | | 5/1991 | da Silva | 131/60 |
| 5,169,082 | | 12/1992 | da Silva | 242/58.1 |
| 5,174,183 | * | 12/1992 | Werner | 83/176 |
| 5,386,751 | * | 2/1995 | Dylla et al. | 83/24 |
| 5,467,676 | * | 11/1995 | Hooper et al. | 83/176 |

FOREIGN PATENT DOCUMENTS

| | | | | |
|---|---|---|---|---|
| 349350 A2 | * | 1/1990 | (EP) | 242/562 |
| 2101919 | | 1/1983 | (GB) . | |
| 402004627 | * | 1/1990 | (JP) | 242/562 |

* cited by examiner

*Primary Examiner*—Kenneth E. Peterson
*Assistant Examiner*—Charles Goodman
(74) *Attorney, Agent, or Firm*—Clinton H. Hallman, Jr.; Kevin B. Osborne; Charles E. B. Glenn

(57) ABSTRACT

An apparatus for the opening of paper bobbins and other rolls of material is provided. A flat blade is advanced from the side of a wound roll of material such that it intersects the roll over substantially its entire width. A cutting blade or other cutting mechanism then severs the layers of the roll which are outside the flat blade, and the flat blade protects the inside layers from being damaged. In preferred embodiments, a jet of air or other gas may be used to ease the insertion of the flat blade, or a gripping device which pinches the surface of the roll between opposed friction pads creates an arch in the surface of the roll through which the blade is inserted. The device is particularly suitable for use in cigarette making machines which require undamaged paper feeds.

8 Claims, 9 Drawing Sheets

APPARATUS FOR OPENING PAPER BOBBINS

CLAIM FOR PRIORITY

Applicants claim priority, under 35 USC § 119, to European Patent Application 94810716.4, filed Dec. 12, 1994.

1. Field of Invention

The present invention pertains to a method and device for opening wound rolls of a supple material, such as paper or fabric. Such rolls are formed by spirally winding the material in superimposed layers, often on a separate support shaft. The roll has a top layer which can serve as a protection layer, the free or "loose" end of which may be attached to the layer directly beneath it, frequently by means of glue.

The roll has two parallel sides formed by the edges of the wound material. The method and the device according to the invention are particularly useful for relatively narrow rolls, namely, those delivering a strip having a maximum width of the order of several centimeters.

2. Description of the Prior Art

Various disclosures, in particular U.S. Pat. Nos. 5,018,535, 4,995,406 and 5,169,082, describe different methods and devices which open a roll of paper or other material to be fed into a manufacturing machine and those disclosures are incorporated herein by reference.

These publications generally provide for a cutting blade that is perpendicular to the unwinding direction of the strip and is applied to the top layer of the roll in order to cut it. Since the cutting blade is pressed onto the top layer with a certain force and/or is inserted a certain distance into the roll, several layers of the roll generally are cut simultaneously, with no way of verifying how many layers have been cut.

With these systems, it often happens that the next layer directly below the last cut layer is damaged by the blade, thus making a weak point that could cause the strip to break at that location at some future time. A break of this type requires a shutdown of the machine which uses the roll of wound material, resulting in a loss of productivity.

In certain cases, the top layer of the roll is covered with a protection band made of a material that can be different from that of the roll. In the following description, the "top layer" of the roll refers to any of: this protection band (if present), the first layer or layers of the roll, or to the protective band and the first layer or layers of the roll.

Application DE 3,215,355 describes a device with a support bar on which are mounted a cutting blade and a layer separating blade. The separating and cutting actions are controlled simultaneously by the movement of the support bar. This device unfortunately makes it impossible to adjust the distance between the support bar and the separating blade, and it is fairly difficult to minimize the height travel setting for the separating blade. As a result of this difficulty, an excessive number of layers must be cut leading to waste.

Furthermore, if the force of the separating blade spring decreases after long use, there can be insufficient compressive force between the support bar and the separating blade, and thus it is possible that one or several layers between the support bar and the separating blade might not be severed properly.

Regarding the paper on the roll itself, since the support bar rests directly on the top layers, the latter is compressed, making it more difficult to insert the separating blade. Also, because the advancing movements of the support bar against the upper layer and those of the separating blade are simultaneous with the cutting movement, the layers to be cut are shifted, causing damage to the layer directly beneath the separating blade and preventing a clean cut of the layers.

Moreover, this device is not capable of making multiple cutting passes, and the fact that the cutting blade is attached to the support bar makes it difficult to replace a worn blade. Furthermore, this device does not have any means of relaxing the tension of the top layers of the roll if said layers are tightly rolled, in which case it is impossible to use the device.

DE 3,918,552 and U.S. Pat. No. 4,821,971 describe devices for opening wide rolls. The problems encountered in this case are essentially different from those which the present invention solves. In particular, devices in these disclosures cannot insert the layer separating blade across the entire width of the roll.

SUMMARY OF THE INVENTION

The device according to the present invention provides a method for opening a roll without damaging the layers which underlie the outer layer of the roll. A flat blade is inserted between the outer layer to be cut and the center of the roll, and the cutting action stops at the flat blade. In one embodiment, the novel device contains a gripping mechanism which grips the top layer or layers of a roll and draws the surface together to form an arched space under that layer. A flat blade is provided for insertion into the roll, preferably at an arched space as described above, and a cutting blade is provided which cuts the top layer, and at the end of its cut is stopped by the flat blade. The layers may also be separated by a jet of air or other gas to ease the insertion of the blade, and the roll may optionally be turned.

One object of the invention is to provide a method compatible with conventional roll handling methods, but which does not have the disadvantages of the prior art and which ensures that the layer directly below the last cut layer is absolutely intact and damage-free, even if the top layer of the rolls are tightly wound.

Another object of the invention is to provide a device for opening a roll with a minimum of damage to the layers, which device can be adapted to a known device for roll opening and that preserves intact the layer directly below the last layer to be cut, even if the top layers of the roll are tightly wound.

An additional object is to provide a device and method for opening a sealed roll which is compatible with cigarette manufacturing machines.

These objects are achieved by the device and method of the present invention.

DESCRIPTION OF THE DRAWINGS

The invention is best described with reference to the following drawings, which are provided by way of illustration and not limitation.

DETAILED DESCRIPTION OF THE INVENTION

Figure 1:
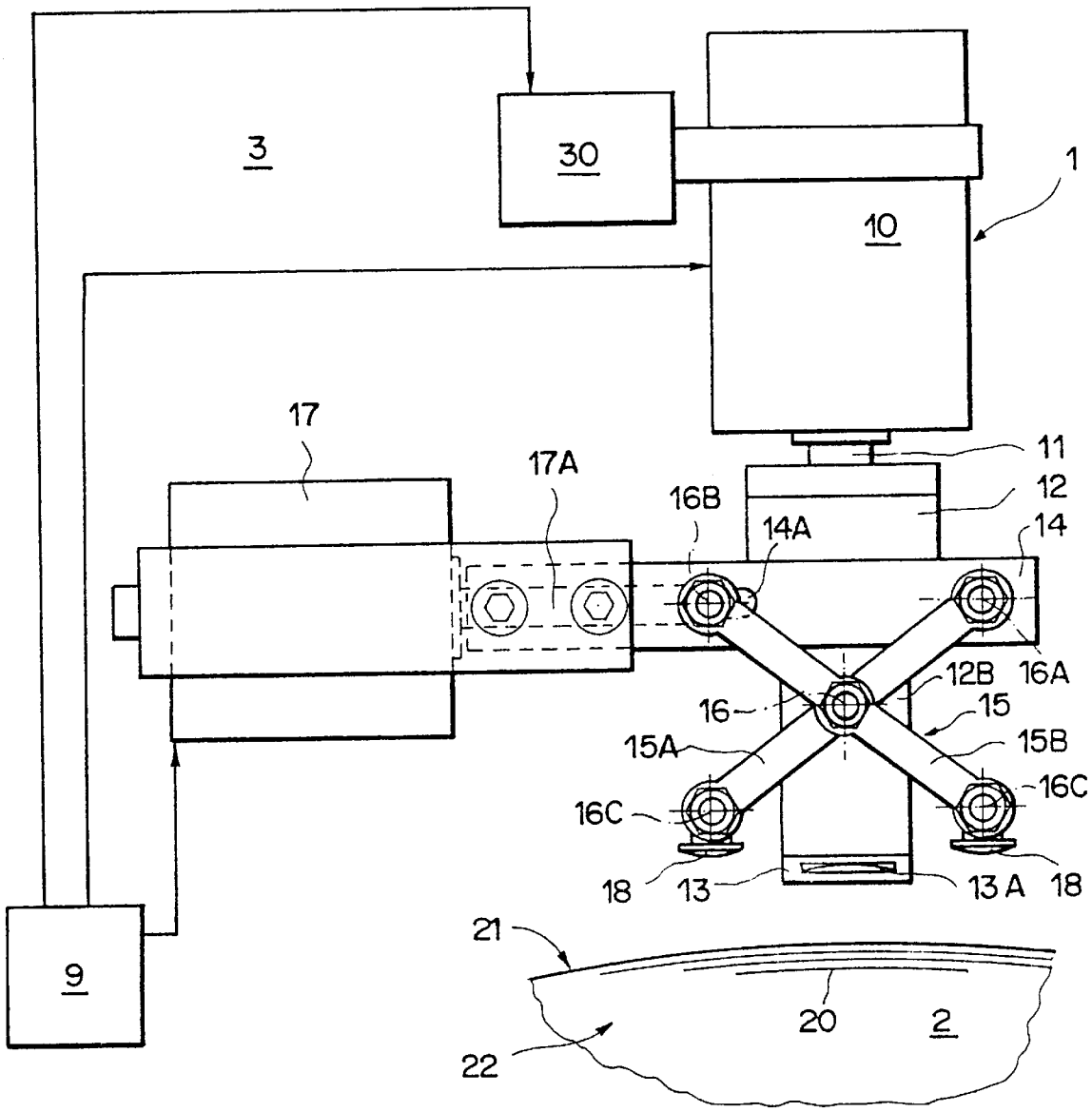
FIG. 1 is a front view of an embodiment of a device according to the invention in the ready position.

In FIG. 1, an exemplary device according to the present invention 1 is shown mounted above a roll 2 that is attached to a support shaft (not shown) and has several layers 20, in particular a top layer 21, the end of which is glued on to the layer directly beneath it in order to seal the roll and prevent unwinding. The roll 2 has two lateral surfaces which comprise its two parallel sides 22.

During the process, the roll 2 is generally stationary on its support shaft, although it is not necessary that it be tightly fit on said shaft. One embodiment of the device 1 comprises a first actuator 10, which may be for example a hydraulic or pneumatic cylinder, the barrel of which is attached to a machine structure 3 by mounting arrangement 30 which may also be movable.

In some cases, the mounting arrangement 30 is movable and can permit the device 1 to be moved into position above the roll 2 for its operation to assist in opening of the roll and then retracted so that it does not interfere with the subsequent operations to be performed on the roll. It is assumed that, during the operation of the opening device 1, the outer casing of the actuator 10 (in this case the cylinder barrel) is fixed and immobile with respect to the roll 2. The actuator 10 comprises a movable rod 11 that can travel in either direction perpendicular to the roll support shaft and that points toward said support shaft.

Figure 2:
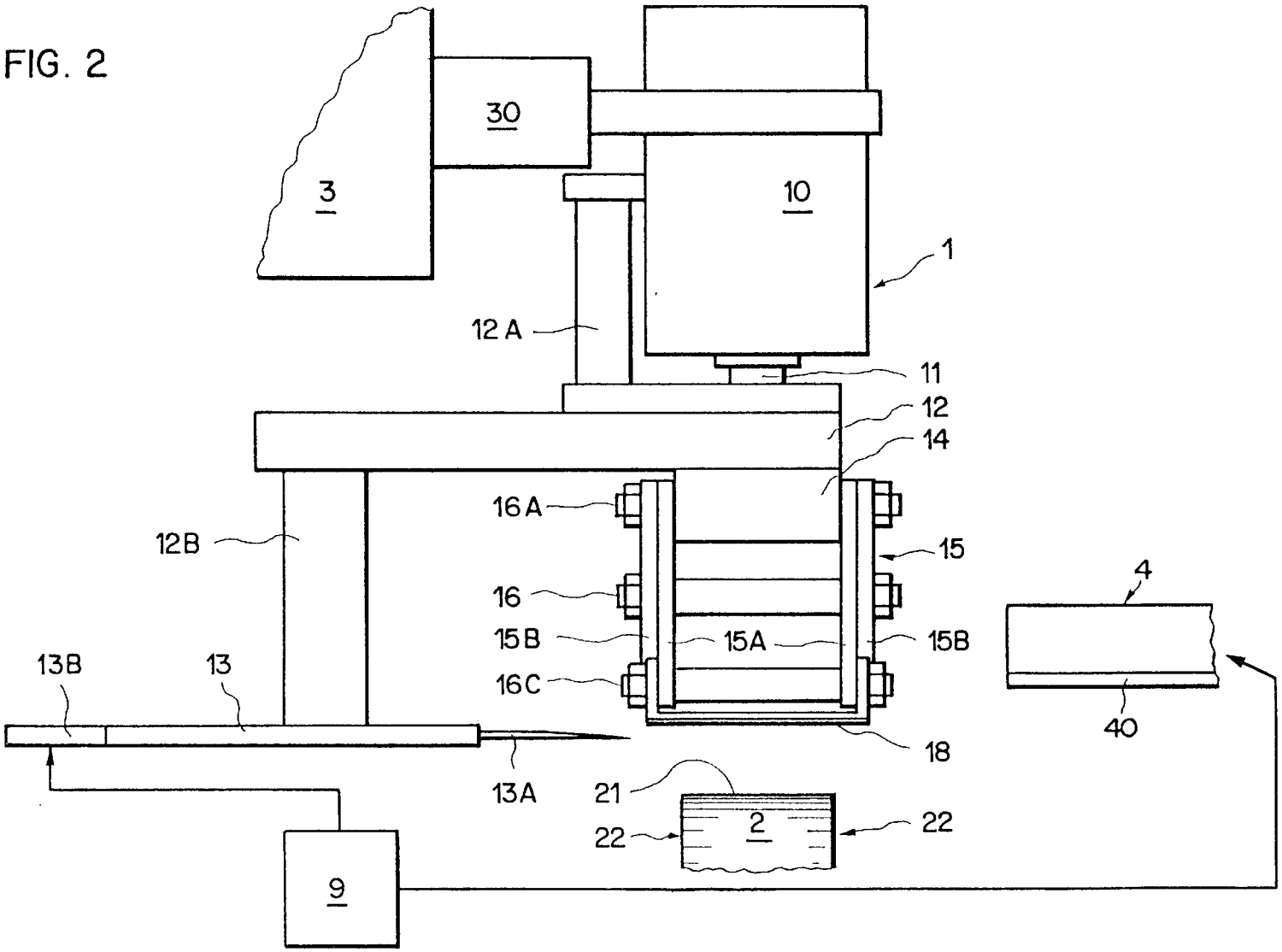
FIG. 2 is a side view of the device illustrated in FIG. 1 in the same position.

The end of the movable rod 11 of the cylinder 10 is attached to a first support 12 that extends parallel to the roll support shaft, preferably behind the roll 2 as shown in FIG. 2. Guide 12A prevents the rotation of the support 12 in order to keep the support 12 aligned with the roll support shaft. At the back end of the support 12, a column 12B keeps a blade holder 13 at a certain fixed vertical distance from the support 12.

Figure 4:
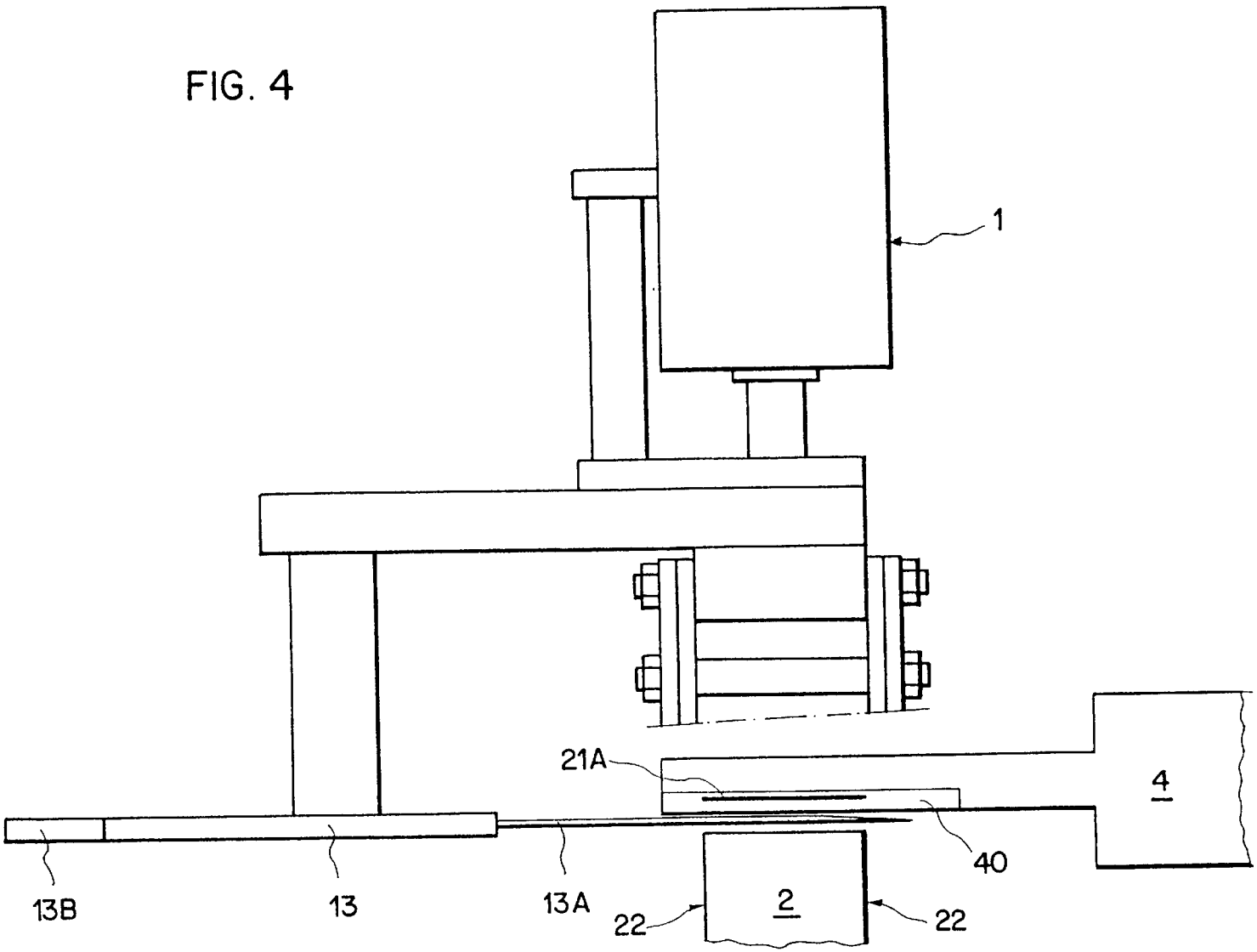
FIG. 4 is a side view of the device of FIG. 2 in operation.

A flat blade 13A can slide into the blade holder 13 in a direction parallel to the support shaft of the roll 2, and can move from the retracted position shown in FIG. 2 to a position extended toward the roll 2, as shown in FIG. 4. The extension and retraction movements of the flat blade 13A are produced by a second hydraulic or pneumatic actuator 13B built into the blade holder 13.

A second support 14 generally oriented in a direction perpendicular to the support shaft of the roll 2 and also to the direction of motion of the movable rod 11 is attached to the underside of the support 12. A double set of cross-linkages 15, each consisting of a pair of bars 15A and 15B, is mounted on the two sides of the support 14 parallel to the sides of the roll 2 and below said support.

A first center pin 16 connects each of the cross-linkages 15, said pin being preferably in the center of each of the bars 15A and 15B, permitting said bars to pivot about said first center pin. The upper end of each bar 15A is fixed against the opposing surface of the support 14 by means of a second pin 16A which extends through said support and allows said bars to pivot simultaneously about said second pin. The upper ends of the bars 15B are similarly connected by a third pin 16B, said pin being capable of sliding, in a direction perpendicular to the shaft of the roll 2 and also to the travel of the first movable rod 11, in a slot 14A that traverses the support 14 and extends in the direction of the second pin 16A.

The distal end of the support 14 in relation to the end attached to the support 12 supports a third actuator 17, which also can be a hydraulic or pneumatic cylinder and which has a second movable rod 17A, the end of which is attached to the pin 16B and is capable of moving said pin in a parallel manner in the slot 14A and in the direction defined above. The lower ends of each of the bars 15A and of each of the bars 15B are connected by two fourth pins 16C, said pins not pivoting with respect to the bars 15A or the bars 15B.

Each of the two pins 16C supports a friction pad 18, said pads being located beneath the lower ends and connecting together, respectively, the two opposing bars 15A and the two opposing bars 15B. The friction pads 18 thus are parallel to the support shaft of the roll 2 and each is covered on the surface facing the roll 2 with a coating having a high coefficient of friction with respect to the material comprising the layers 20 of the roll, for example, with rubber. Preferably, the contact surfaces of said coatings are rounded, and longitudinal grooves can be provided on said surfaces. Preferably, the spacing between the two opposing cross-linkages 15, and thus the length of the respective friction pads 18, is at least equal to the width of the material strip comprising the roll 2.

In the position shown in FIG. 1, the movable rod 17A of the actuator 17 is in the retracted position, and thus the pin 16B is in the position farthest from the pin 16A. By actuating the actuator 17 so that the pin 16B approaches the pin 16A, a scissors effect is obtained with the cross-linkages 15, whereby the lower ends of the bars 15A and 15B of each cross-linkage converge, along with the two friction pads 18. By means of the same scissors effect, the two friction pads 18 descend slightly toward the roll 2. During the same movement, since each bar 15A pivots about the pin 16A, while each bar 15B pivots in the opposite direction about the pin 16B, the ends of the bars, and consequently the contact surfaces of the pads 18, pivot slightly toward each other.

Also shown in FIG. 2 is a cutting device 4 which comprises particularly a cutting blade 40 and which is shown in the ready position.

Now the different steps of the method of opening the roll including the cutting of the top layer 21 of the roll 2 can be described. As mentioned above, the roll 2 is stationary on its support shaft. With reference to FIGS. 1 and 2, the mounting arrangement 30 for positioning the preparation device 1 are actuated so as to position said device close to the top layer 21, the two friction pads 18 being slightly above the layer 21 and parallel to the roll shaft but not in contact with the layer 21, while the blade 13A is positioned several tenths of a mm below the upper surface of the top layer 21. This distance at which the flat blade 13A is positioned in relation to said upper surface depends essentially on the thickness of the strip of material comprising the top layer 21.

In this position, the actuator 10 holds the movable rod 11 in the retracted position, while the actuator 13B holds the flat blade 13A in the retracted position and the actuator 17 holds the pin 16B in the position farthest from the pin 16A. This starting position of the device 1 in relation to the roll 2 can be set manually or automatically by a position detecting device (not shown, but which can be of the same type as that described below with regard to a second arrangement of the invention) connected to a control unit 9 capable of determining whether the device is correctly positioned above the layer 21 and whether the flat blade 13A is correctly positioned relative to said layer.

Figure 3:
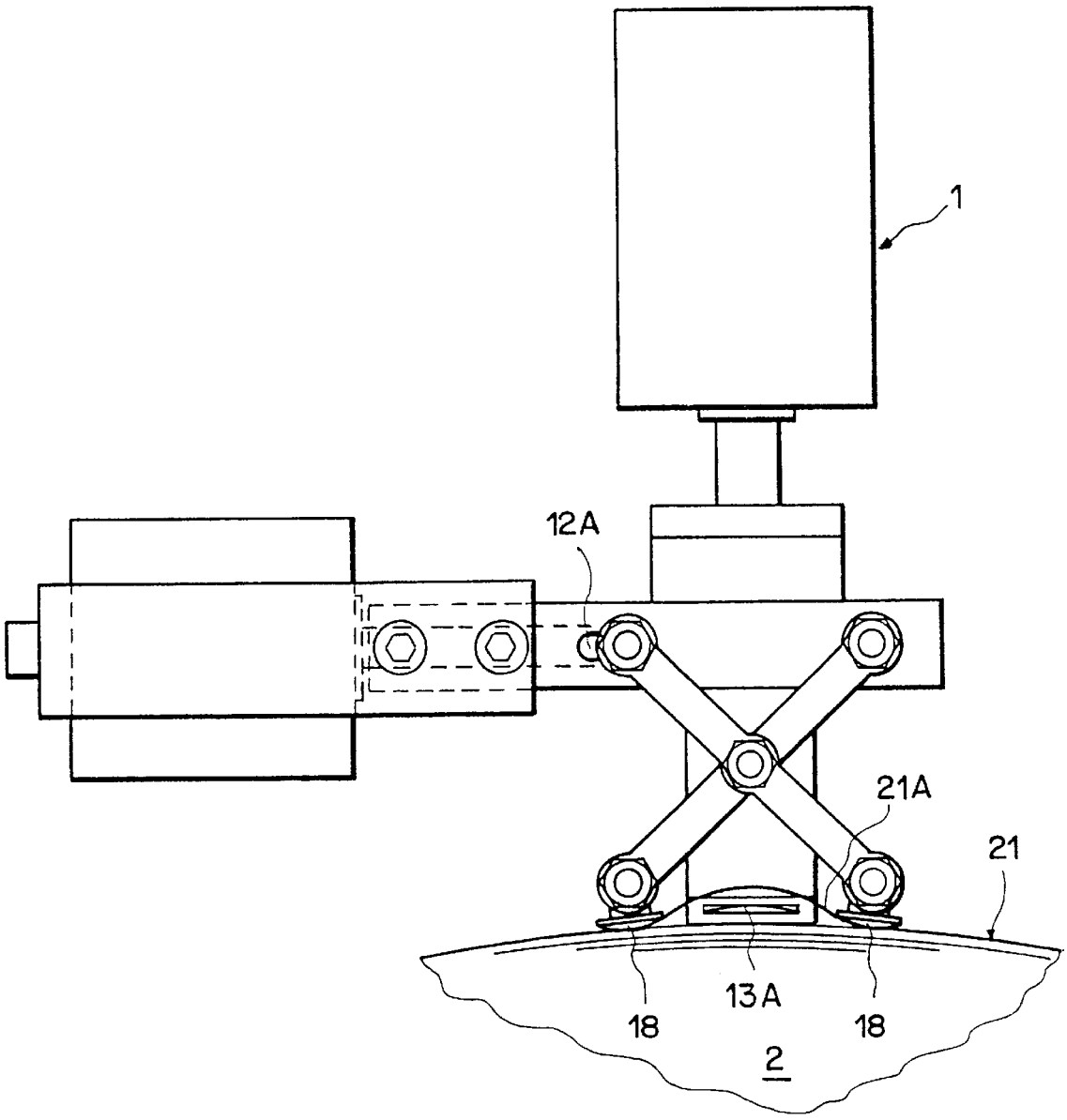
FIG. 3 is a front view of the device of FIG. 1 in operation.

After this starting position has been set, the actuator 17 is actuated, which moves the pin 16B toward the pin 16A, causing a downward movement where the contact surfaces of the friction pads 18 descend to contact and then press against the layer 21, after which the two said pads converge with an accompanying pivoting movement. These movements of the two pads 18 suffice, after the latter are in contact with the top layer 21, to slightly pinch the layer and then lift and form an arch 21A between the two pads 18, as shown in FIG. 3. This arch 21A in the layer 21 is thus caused by a combination of the above-described movements, first a strong contact between the pads 18 and the two distant surfaces of the layer 21 and then the convergence and pivoting of the two pads which, because of the high coefficient of friction of their coatings, do not slide over the layer 21.

When the arch 21A is created, the actuator 17 is stopped, and then the actuator 3B is actuated in order to advance the flat blade 13A so that the end of said blade passes through the space beneath the arch 21A, that is, between the top layer 21 and the lower layers 20. At this moment, the flat blade 13A is maintained in this position and the cutting device 4, along with the cutting blade 40, is brought between the bars of the cross-linkage 15 directly above the arch 21.

Thus the blade 40 can cut the arch 21A, namely, the top layer 21, while penetrating only as far as the flat blade 13A, against which it finally comes to rest. Thus the flat blade 13A has protected the first of the lower layers 20, which thus cannot be damaged by the blade 40. Preferably, the end of the flat blade 13A inserted between the two layers of the roll 2 is rounded so as not to damage the layers. After this cutting operation has been performed, the cutting blade 40 is retracted, then the flat blade 13A is retracted by the actuator 13B, then the actuator 10 is again actuated in order to retract the pads 18 from the layer 21 and the movable mounting arrangement 30 moves the device 1 away from the roll 2.

The top layer 21, that which is cut by the blade, may comprise an outer protective layer, a single layer of wound material, or several layers of wound material. In a preferred embodiment, the arch 21A consists of several top layers of the roll (and possibly a protection band as well) and thus several layers are cut. This is advantageous because if at least two layers are cut, then the place where the end of the top layer is glued to the layer directly below is sure not to be in the usable strip.

The various movements of the actuators are controlled by the control unit 9.

Although the device for opening of a roll was described above by way of example in reference to a single preferred arrangement, other versions of this arrangement may be envisioned by one of skill in the art having regard for this disclosure. For example, it is not necessary that the device 1 be placed in a vertical position above the roll 2, but in fact it could be oriented at any angle to the center of the roll, as long as the relative angles of the various movements described are maintained.

Similarly, the actuators described as being pneumatic or hydraulic cylinders could consist of any element capable of producing the movements described. Another arrangement could be proposed for the means of making the two pins 16A and 16B converge, for example, a rod having two sections threaded in opposite senses and being rotated by an actuator 17, with one threaded section passing through a threaded hole in the pin 16A and the other through a threaded hole in the pin 16B. It is also possible that both pins could converge simultaneously, rather than only one pin moving.

Similarly, the center pin 16 was described as being in the center of each of the bars 15A and 15B, but in fact it could be shifted so that the movement of the pads 18 is multiplied or divided in relation to the converging movement of the two pins 16A and 16B. It is also possible that the support 14 for the cross-linkages 15 and the friction pads 18 can be independent of the support 12 for the blade 13A, so that it can be moved away from the roll 2 after the blade 13A has been inserted into the roll, so as to allow, if necessary, sufficient room for the cutting device 4.

Another arrangement of a device for opening of a roll is shown in FIGS. 5 through 8.

As previously, a roll 2 comprising several layers 20 and in particular a top layer 21 is fit on a support shaft, which is not shown. This preparation device consists of a blade holder device 5, a position detecting device 6, and a control unit 9, and also could be equipped with a blowing device 7. These various elements are shown as separate from one another in order to make the figures clearer, but they are obviously part of the same group and are attached to a common plate equipped with displacement means capable of moving said elements into the operating position near the roll 2.

Figure 5:
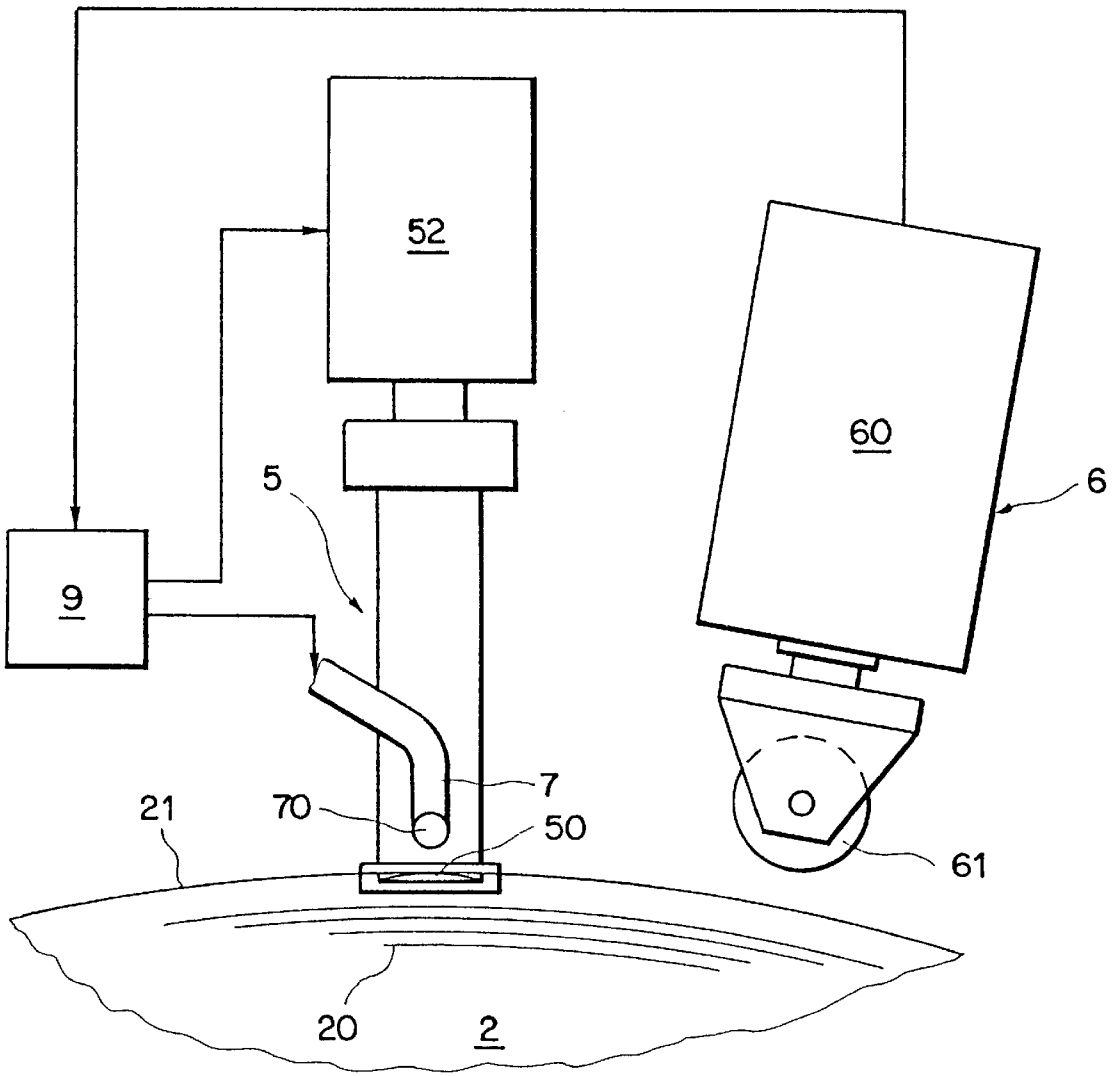
FIG. 5 is a front view of a second embodiment of a device according to the invention in the ready position.
Figure 8:
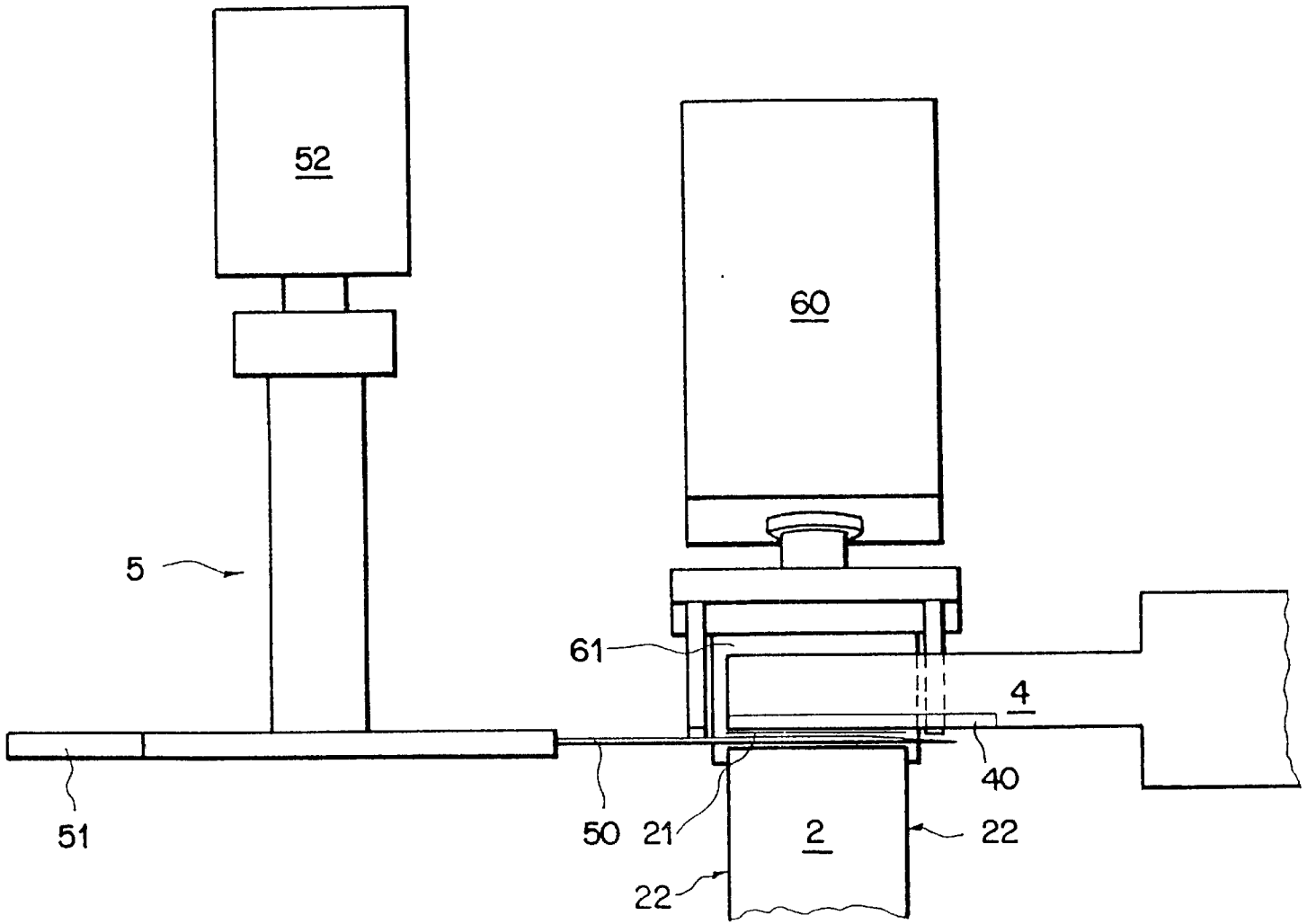
FIG. 8 is a side view of the device of FIG. 6 in operation.
Figure 9:
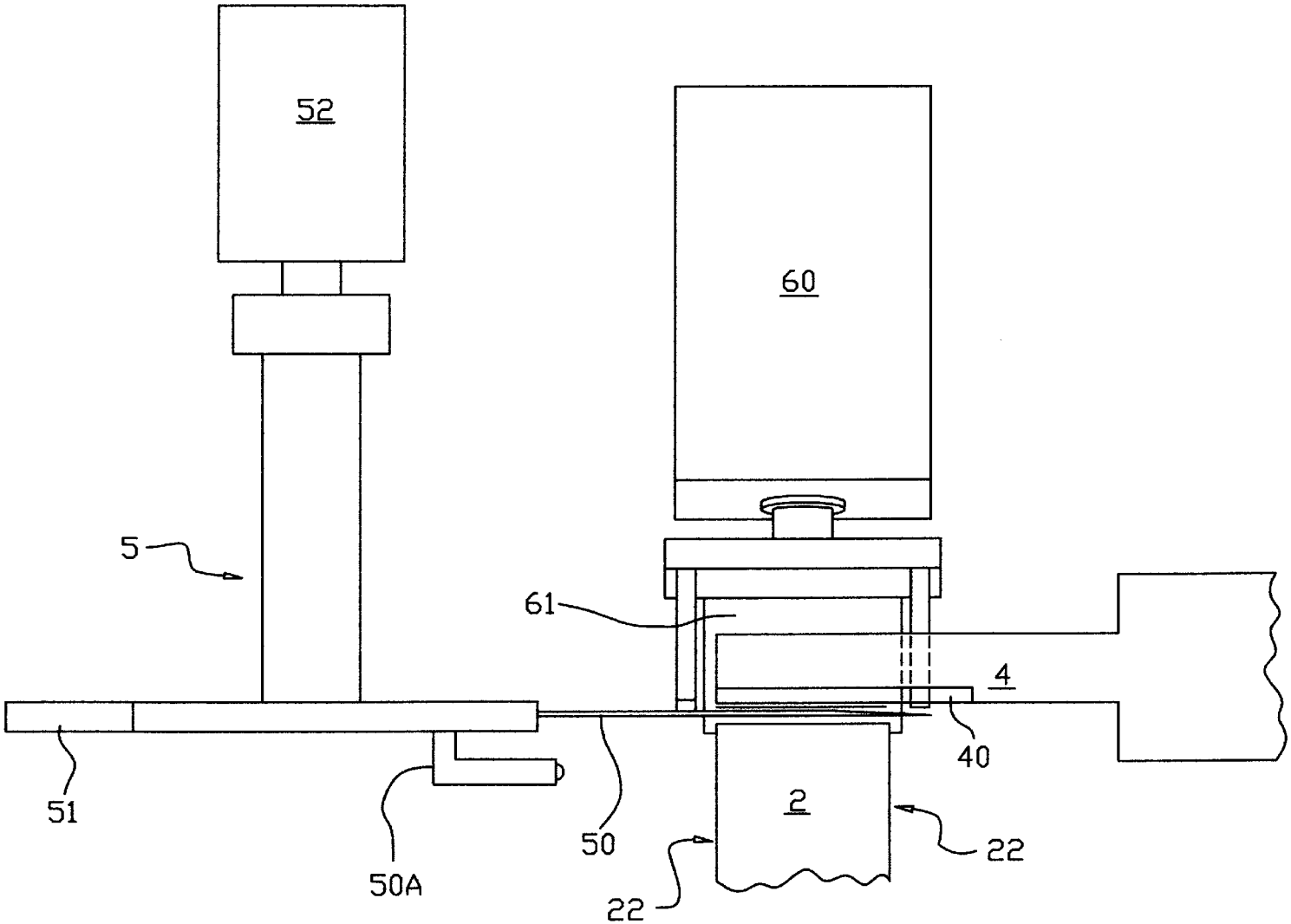
FIG. 9 is a side view of the device of FIG. 6 after the cutting stroke.

The blade holder device 5 comprises a flat blade 50 which is exactly like the flat blade 13A described above and which is capable of assuming a retracted position as shown in FIG. 5 or an extended position as shown in FIG. 8 by means of an actuator 51. The blade holder 5 is mounted on another actuator 52 capable of positioning the flat blade 50 very precisely with respect to the top layer 21 of the roll 2, as will be seen below.

Figure 7:
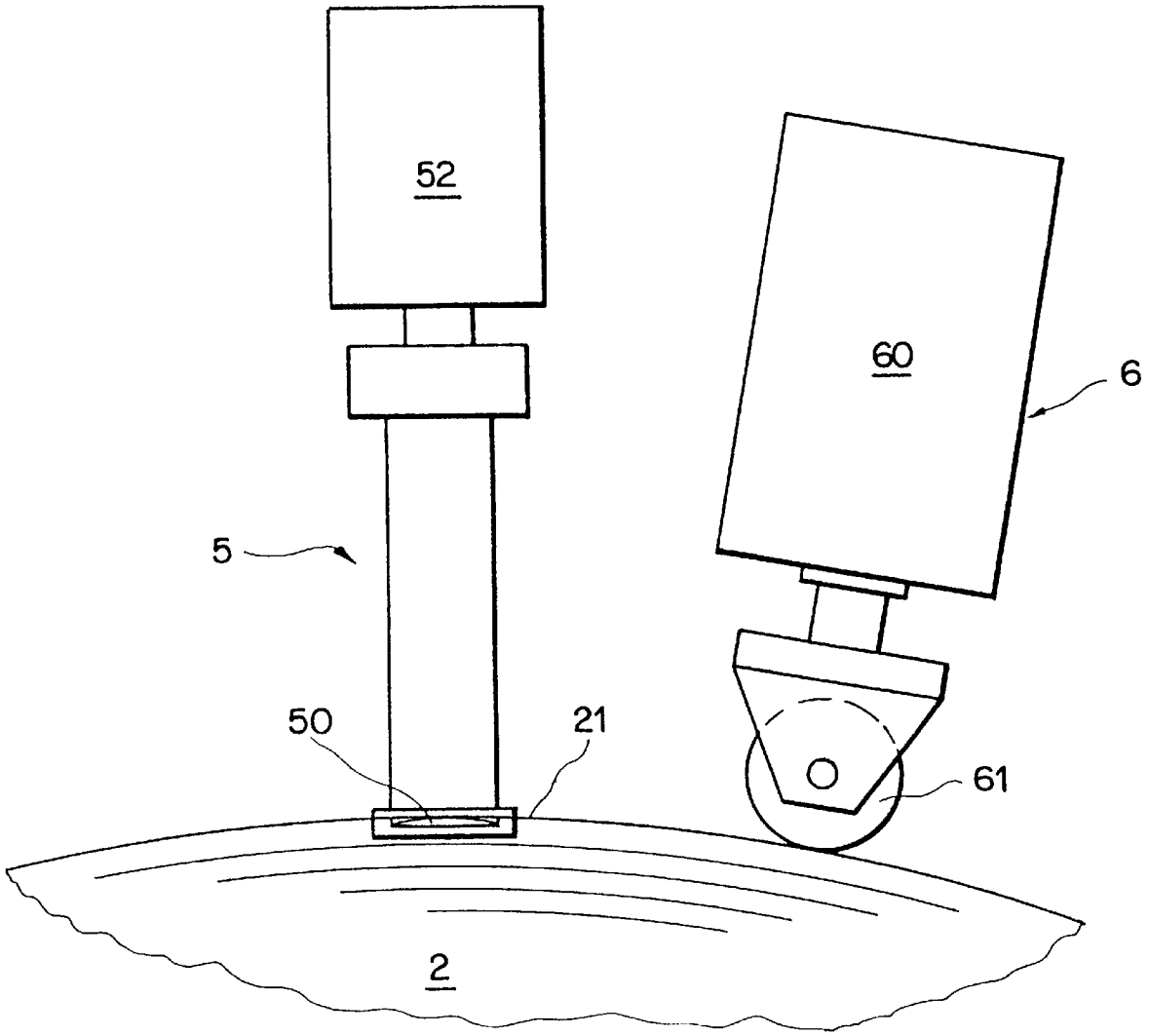
FIG. 7 is a front view of the device of FIG. 5 in operation.

Because not all rolls to be opened will have the same diameter, it is necessary to detect the position of the top layer 21. For this purpose, a device 6 is provided to detect the position of said top layer by means of another actuator 60 equipped with a contact element 61, preferably a roller, which at first is positioned well above the top layer 21, as shown in FIG. 5, and then is lowered until the contact roller 61 touches the top layer 21, as shown in FIG. 7.

This positioning is controlled by the control unit 9, which also can actuate the actuator 52 in order to place the flat blade 50 several tenths of a mm below the corresponding edge of the upper surface of the top layer 21. The distance at which the flat blade 50 is placed relative to said upper surface depends on the thickness of the material strip comprising the roll 2.

Assuming that the layers of the roll 2 are not too tight, the blade 50 is gently inserted beneath the top layer 21 and preferably, for the reason indicated previously with regard to the first arrangement, beneath at least the two top layers. This advancing movement of the flat blade 50 can be accomplished when the roll 2 is stationary or when the latter is rotating slowly in the direction from the roller 61 toward the flat blade 50.

Preferably, the direction of this rotation is opposite to that of the normal unwinding of the roll, so that during this rotation the flat blade 50 tends to be pushed upward by the spiral winding of the roll layers. During this rotation, the roller 61 can continue to detect the position of the top layer 21 in order to correct the position of the flat blade 50 in case the roll 2 is not exactly circular.

Figure 6:
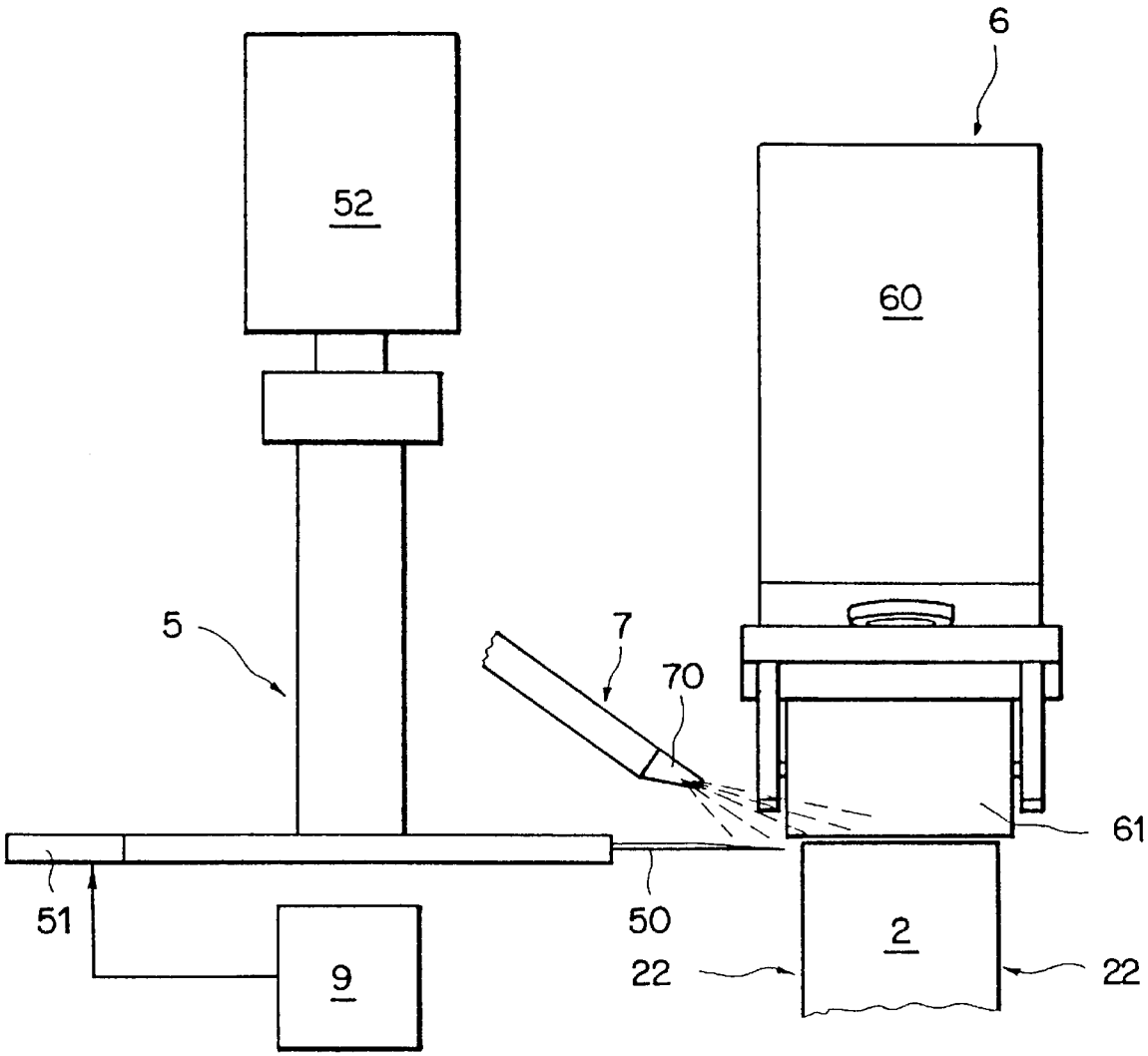
FIG. 6 is a side view of the device of FIG. 5.

When the flat blade 50 is completely inserted, the roll is stopped if it has been rotating and, as for the first arrangement described above, a cutting device 4 is brought in to cut the layers that are above the flat blade 50 and only those layers, the cutting movement being limited by the flat blade 50. As shown in FIG. 6, the device can be augmented with a blowing device 7 consisting essentially of a blowing nozzle 70 which sprays a jet of pressurized air directly above the flat blade 50 toward the roll 2 in order to lift the top layers, thus facilitating the insertion of the flat blade 50. A roller exerting force on the side of the roll may also be used. The detecting means 6 also can be designed so that there is no contact with the top layer 21, for example, by employing an optical detection means.

The flat blade may optionally be formed with a groove along the width of the roll to guide the cutting blade and prevent damage to or dulling of the blade.

A device according to the arrangements or the variations described above makes it possible, when used in conjunction with a device for cutting and taking hold of the top layers of a roll, to obtain an intact strip of material for subsequent use, said strip not having been damaged by the cutting device.

Having described the invention above, we claim:

1. An apparatus for opening a roll of a material of a selected width, the roll being formed from the material wound in a spiral, the roll having a plurality of layers of material, and the roll having a center, sides, outer layer, diameter and surface, the apparatus comprising:

a substantially flat blade which travels along a path to completely intersect the width of the roll of material from a side between two layers at a position between the center and surface of the roll, and a cutting device which traverses the width of the roll independently of the substantially flat blade to sever the material between the flat blade and the surface of the roll, wherein the substantially flat blade remains stationary relative to the transverse movement of the cutting device.

2. An apparatus as claimed in claim 1, wherein the substantially flat blade is mounted on a blade holder which is connected to a first adjustable displacement device for positioning the flat blade at a selected location along the diameter of the roll between the center of the roll and the outer layer, and the blade holder is connected to a second displacement device which advances the blade along the path to intersect the width of the roll between the layers of material from a side.

3. An apparatus as claimed in claim 2, further comprising a spacing device which separates the layers of material at the selected location on the diameter of the roll where the flat blade intersects the roll.

4. An apparatus as claimed in claim 3, wherein the spacing device comprises a device which frictionally engages the surface of the roll, and displaces the surface to form a space between layers.

5. An apparatus as claimed in claim 4, wherein the device which frictionally engages the surface of the roll comprises two friction pads which frictionally engage the surface of the roll and are displaced convergingly to pull the surface.

6. An apparatus as claimed in claim 5, wherein each of the two friction pads contains an engaging surface which is formed from a friction material having a sufficient coefficient of friction with the roll material to prevent slippage of the engaged friction pad on the surface of the roll.

7. An apparatus as claimed in claim 4, wherein the device which frictionally engages the surface of the roll comprises at least one pair of bars having upper and lower ends, the bars being connected by a center pivot pin which pin is parallel to a longitudinal axis of the roll, the lower ends each being connected to a friction pad, whereby when the upper ends of the bars are displaced together, each lower end draws a friction pad together with another friction pad on another lower end connected by the pivot pin to pull the surface.

8. An apparatus for opening a roll of a material of a selected width, the roll being formed from the material wound along a longitudinal axis in a spiral, the roll having a plurality of layers of material, and the roll having a center, sides, outer layer, diameter and surface, the apparatus comprising:

a layer separating device having displaceable friction pads which engage the surface of the roll and are drawn together convergingly to form an arch from the outer layer of the roll, a substantially flat blade which travels along a path and is mounted in a blade holder which is connected to a first adjustable displacement device, which first displacement device positions the flat blade at a selected location along the diameter of the roll between the center of the roll and the outer layer, said blade holder also being connected to a second displacement device which advances the blade along the path to intersect the roll between the layers of material from the side, which path of travel substantially completely intersects the width of the roll of material between two layers at a position between the center and surface of the roll where the arch is formed, and a cutting blade which traverses the width of the roll independently of the substantially flat blade to sever the material between the flat blade and the surface of the roll with a cutting stroke and ends the cutting stroke by contacting the flat blade, wherein the substantially flat blade remains stationary relative to the transverse movement of the cutting device.

* * * * *